US011938412B2

(12) United States Patent
Guidrevitch

(10) Patent No.: US 11,938,412 B2
(45) Date of Patent: Mar. 26, 2024

(54) SPINNER TOY AND METHOD OF ROTATING SAME

(71) Applicant: Aleksandr Nikolaevich Guidrevitch, Grodno (BY)

(72) Inventor: Aleksandr Nikolaevich Guidrevitch, Grodno (BY)

( * ) Notice: Subject to any disclaimer, the term of this patent is extended or adjusted under 35 U.S.C. 154(b) by 289 days.

(21) Appl. No.: 17/437,398

(22) PCT Filed: Mar. 5, 2020

(86) PCT No.: PCT/BY2020/000003
§ 371 (c)(1),
(2) Date: Sep. 8, 2021

(87) PCT Pub. No.: WO2020/181352
PCT Pub. Date: Sep. 17, 2020

(65) Prior Publication Data

US 2022/0168657 A1 Jun. 2, 2022

(30) Foreign Application Priority Data

Mar. 12, 2019 (EA) ..... 201900215

(51) Int. Cl.
*A63H 1/06* (2006.01)
*A63H 33/00* (2006.01)

(52) U.S. Cl.
CPC ..... *A63H 1/06* (2013.01); *A63H 33/002* (2013.01)

(58) Field of Classification Search
CPC ..... A63H 1/00; A63H 1/06; A63H 33/002; A63H 31/02
See application file for complete search history.

(56) References Cited

U.S. PATENT DOCUMENTS 1,985,716 A * 12/1934 Bueschel ..... A63H 1/06 446/241
4,355,481 A * 10/1982 Joslyn ..... A63H 1/06 446/241

(Continued)

FOREIGN PATENT DOCUMENTS

CN 107126707 A * 9/2017 ..... A63H 1/00
CN 109260716 A * 1/2019

*Primary Examiner* — Eugene L Kim
*Assistant Examiner* — Alyssa M Hylinski
(74) *Attorney, Agent, or Firm* — Timur Slonim, Esq.; LAW OFFICE OF TIMUR E. SLONIM, ESQ.

(57) ABSTRACT

A spinner toy with operational autonomy from an outside energy source, increased duration of rotation, and improved entertainment qualities is described. A rotating element of a spinner toy is configured to be centrally balanced relative to a central axis of rotation and is equipped with a means of rotation in the form of a ball bearing and screw converter having a housing in the form of a hollow sleeve, which is capable of converting the reciprocating motion of a pusher of the means of rotation into unidirectional rotational motion without slowing the rotating element. The present method includes imparting rotation to the rotating element without interrupting the use of the spinner toy by a user by means of mechanically converting the reciprocating motion of the pusher of the means of rotation in the form of a ball bearing and screw converter into unidirectional rotational motion without slowing the rotating element.

16 Claims, 4 Drawing Sheets

(56) References Cited

U.S. PATENT DOCUMENTS

| | | | | |
|---|---|---|---|---|
| 5,169,354 | A * | 12/1992 | Norton | A63H 1/06 446/241 |
| 5,238,440 | A * | 8/1993 | Morin | A63H 1/06 446/241 |
| 9,366,326 | B2 * | 6/2016 | Lee | B43K 24/084 |
| 2010/0279826 | A1 * | 11/2010 | Weinstock | A63B 23/16 482/47 |
| 2018/0345155 | A1 * | 12/2018 | Philgreen | A63H 1/00 |
| 2018/0369703 | A1 * | 12/2018 | Sorias | A63H 1/00 |
| 2019/0160388 | A1 * | 5/2019 | Hacsi | A63G 1/00 |

* cited by examiner

SPINNER TOY AND METHOD OF ROTATING SAME

CROSS-REFERENCE TO RELATED APPLICATIONS

This application is a US national stage under 35 USC 371 of PCT/BY2020/000003 filed on Mar. 5, 2020, which claims priority to Eurasian application no. 201900215 filed on Mar. 12, 2019. The entire content of these applications is incorporated by reference herein.

FIELD OF THE INVENTION

The invention relates to the sphere of entertainment and is intended for gaming purposes, and can also be used for the therapy of the psychoemotional state of a person and the development of motor skills of fingers and hands.

BACKGROUND OF THE INVENTION

There are many different designs of spinner toys that rotate in the user's hands, characterized by the presence of a flat body, in which a ball bearing is centrally installed, located in the central hole of the flat body, [1, 2, 3, 4, 5, 6].

The patent [1] describes a finger spinner that includes a main body with a hole in the center into which a bearing in a protective casing is inserted. The bearing contains two end surfaces and means for connecting to an axial hole. The spinner has a central concave end surface rigidly mounted in the central hole.

There is also a finger spinner [2] made of composite material. The spinner contains a gyroscopic body, a central body with covers and ball bearings on the central axis of the lower surface of the body. The upper bearing is installed in the cover of the central tubular shaft in the hole in the lower cover on the lower surface of the tubular shaft. The spinner is characterized by smooth spinning, high strength and light weight.

The patents [3, 4] also describe a hand spinner with a flat body containing several, at least three, blades mounted on the outer edge of the rotating body. The rotating body contains a central through hole in which a bearing is installed and is closed by the bottom and top covers, and holes are provided in the cover bodies. The cover bodies are connected to each other by a threaded joint. The spinner has an elongated shape and is characterized by the ease of rotation of the blades with the user's fingertip.

The patent [5] describes a spinner with a rotating flat body and an assembly unit that includes a central roller bearing of the rotation mechanism. The assembly unit is equipped with release arms with blades. The arms of the blades contain light modules that are activated when the first arm is applied with the user's finger to drive the spinner's flat body in rotation.

A common disadvantage of the known analogs is the impossibility to maintain a long rotational motion of a flat body, since the rotation mechanism is activated exclusively by a single swipe action of the user's finger on the peripheral surface of the flat body. The disadvantage is also the impossibility to speed up the spinner's rotation by touching it again during its rotation, since such an impact leads to its slowdown.

There is also a device designed for rotation in the hands of the user and represents a spinner, which in technical essence is the closest to the proposed invention and was chosen as a prototype [6]. The device contains a structural element in the form of a flat (planar) body with a centrally mounted ball bearing located in the central hole of the flat body and a button for holding the spinner between the user's fingers, while the body has a flat hub and spoke shape. The outer ring of the ball bearing is attached to the flat body, and the button contains a pair of bearing caps attached to each other through a ball bearing and clamped against the internal stroke of the ball bearing, while during the operation of the spinner, the button is held between the user's thumb and forefinger, and the flat body rotates freely together with the outer ring of the ball bearing. At opposite ends of the flat body, several, at least two, loads are mounted, which are made in the form of a sandwich and are placed with the possibility of at least bipolar distribution of their weight. Each load contains at least one hole for adjusting its weight. The flat body comprises at least one load mounting hole at each end and designed to align with at least one load mounting hole in each load.

At each end of the planar body, designed to accommodate at least one balancing mass, a groove is made located between two loads in the form of a sandwich at each end. The first and second bearing caps contain a pair of supporting caps, the first bearing cap contains a first hole in the bearing cap and the second bearing cap contains a second hole in the bearing caps. A pair of supporting caps are secured to each other by a bearing cap, with the bearing cap post extending through a ball bearing and screws into each bearing cap, while a center support screw passes through a first hole in the first bearing cap and through a center hole. Also, the center support bolt passes through the second hole of the second bearing cap and is threaded into the center hole to engage with the center support screw. A flat (planar) body is made solid with a plurality of loads that are built into it; it also contains an element selected from the group consisting of two or three polar ends with two or three ends. The flat body is in the form of a sleeve, spoke, or is a single flat structural element, with each of the loads placed at each end from the center of the planar flat body in a shape corresponding to the shape of its end.

The disadvantage of the prototype is the inability to maintain the initial rotation of the spinner for a long enough time, since a flat (planar) body is brought into rotation by the mechanical swipe action of the user's finger on its peripheral surface, while a repeated similar action leads to interruption of the spinner rotation cycle and the process of rotation of the planar body needs to be repeated anew.

The patent [7] describes a magnetic spinner toy and a method of its rotation, selected as a prototype. A spinner toy contains many, but at least three, rotating bodies. On each rotating body, magnets are mounted on the peripheral surface. The spinner is equipped with an electric motor with a power source, and the electromagnetic mechanism of the motor is designed to interact with the magnetic poles of a magnet of at least one of the rotating bodies. The spinner rotation method includes the interaction of magnetic poles with the electric mechanism of the engine and their alternating attraction and repulsion, which leads to rotational motion of the spinner's rotating bodies.

The disadvantage of the method—a prototype and a magnetic spinner toy based on it—is the use of a magneto-electric drive as a means of rotation, since its implementation requires replaceable electric batteries or a battery that require periodic replacement or recharging, which ties the user to a source of third-party electrical energy and complicates or makes it impossible to use the toy without an outside source of energy.

SUMMARY OF THE INVENTION

The aim of the invention is to eliminate these disadvantages and increase the attractiveness of the spinner toy for the user.

The technical result is the independence of the spinner from an external energy source and an increase in the duration of rotation of a flat (planar) body without interrupting the spinner rotation cycle, which is limited only by the user's desire. The technical result is also the improvement of the playing qualities of the spinner toy due to the high technological effectiveness of the design, which is free from outside energy sources.

The technical result is achieved due to the fact that a spinner toy contains a rotating element of a predetermined shape with a centrally mounted means of rotation, which is mounted in the neutral hole of the rotating element, and the outer surface of the body of the means of rotation is attached to the rotating element; the top and lower button covers are connected to each other through the means of rotation and made with the possibility of holding them between the user's fingers, while the rotating element is provided with symmetrically placed and massive elements and is made with the possibility of free rotation around the central axis, the rotating element is made centrally balanced with respect to the central axis of rotation, and the means of rotation is made in the form of a ball bearing and screw converter of reciprocating motion into unidirectional rotational motion of a rotating element, while the body of the ball bearing and screw converter is a hollow sleeve, the inner surface of which is provided with a helical groove of a given profile, and in the lower end of the hollow sleeve a rotation bearing is mounted, closed lower cover-button, and a guide rod, upper end, is installed in the inner ring of the rotation bearing; the rod contains a blind cavity and is kinematically connected to the pusher, which is located on the upper end of the hollow sleeve and is made to slide along the guide rod, wherein the pusher is made in the form of a hollow cylinder, in the lower end of which a thrust bearing is installed; top cover-button is mounted in the upper end of the pusher cylinder, it is removable and a spring is installed under it, one end of which is recessed into the blind cavity of the guide rod, and the other rests against the top cover-button, while the spring is made with the ability to return the pusher to its original upper position after the user has removed the load from the top cover-button when rotating the rotating element.

The rotating element has a shape similar to a flat disc and is rotatable about a central vertical axis that runs perpendicular to the flat surface of the disc.

The rotating element has the shape of a volumetric body, which is made with the possibility of rotation about a vertical axis passing through the center of gravity of the volumetric body.

On the inner surface of the body of the hollow sleeve, at least two helical grooves of a given profile are made, while their beginning and end are made turning into circular single-turn grooves.

The technical result is also achieved due to the method of rotation of the spinner toy described above, including imparting rotation to the rotating element with the centrally installed means of rotation, the rotation movement of the rotating element is imparted without interrupting the use of the spinner toy by the user by continuously maintaining its rotation by means of mechanical transformation of the reciprocating motion of the pusher of the means of rotation in the form of a ball bearing and screw converter into unidirectional rotational motion without slowdown of the rotating element.

The reciprocating motion of the pusher of the ball bearing and screw converter is performed by periodically pressing the spring-loaded top button cover of the ball bearing and screw converter, followed by the return of the pusher with the help of the spring to its original upper position, with simultaneously holding the spinner toy with a rotating element in the playing position between the user's fingers.

BRIEF DESCRIPTION OF THE DRAWINGS

Different embodiments of the invention are illustrated in drawings in FIG. 1-10.

DETAILED DESCRIPTION OF THE INVENTION

Figure 1:
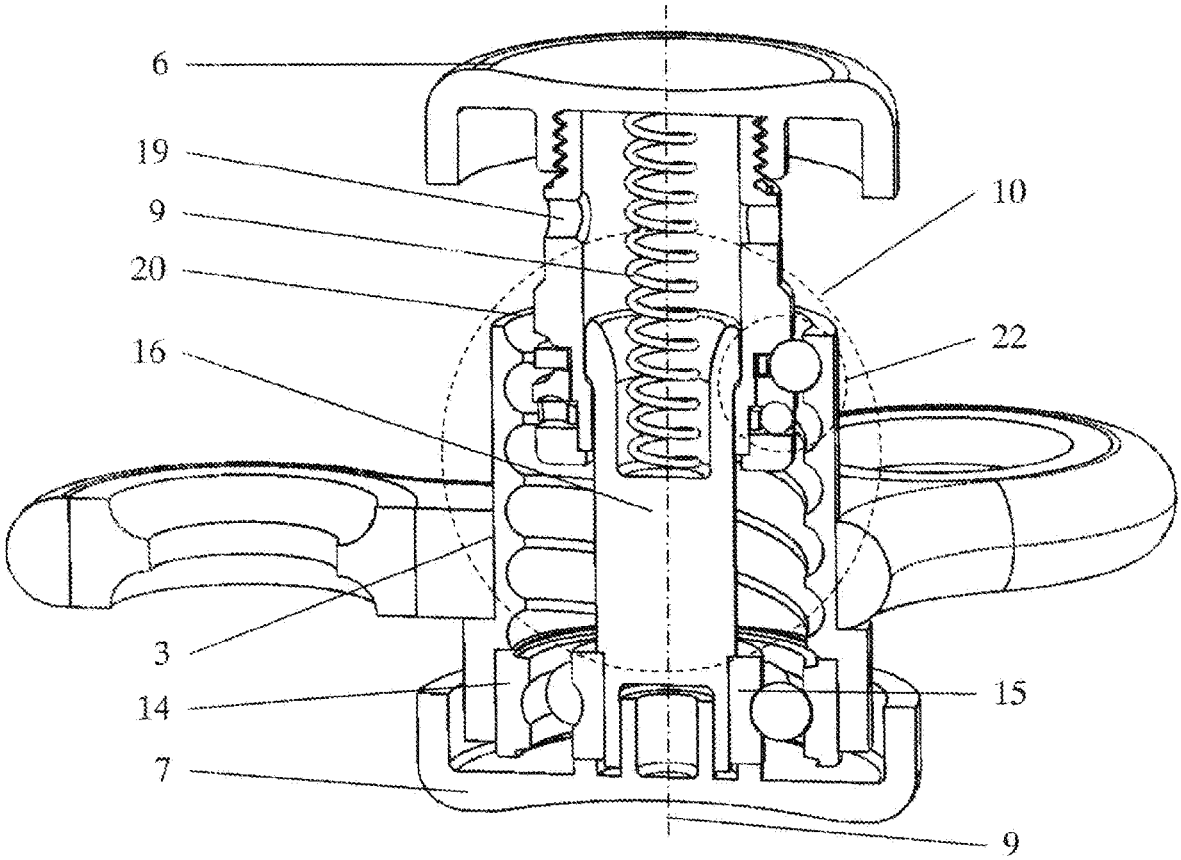
FIG. 1 is a longitudinal sectional view of a spinner toy.

The spinner toy includes a rotating element 1 with a central hole 3, a central axis of rotation 9 and massive elements 8 (also known as weights); means of rotation 2 in the form of a ball bearing and screw converter 10 of reciprocating motion into unidirectional rotational motion of the rotating element 1; the ball bearing and screw converter 10 contains a housing 5 in the form of a hollow sleeve 11 with an outer surface 4, a removable top 6 button cover in the upper end of the pusher 19 cylinder and a lower 7 button cover, which are connected to each other through a means of rotation 2; the hollow sleeve 11 is provided with helical grooves 12 of a given profile on the inner surface, turning into circular single-turn grooves 30, and a rotation bearing 14 and a lower 7 button cover are installed on its lower end 13; the rotation bearing 14 in the inner 15 ring contains a guide rod 16 with a blind cavity 18 in the upper end 17, which is connected with a pusher 19 located on the upper 20 end of the hollow sleeve 11; the pusher 19 in the lower end 21 contains a thrust ball bearing 22 with a thrust washer 23 attached to the lower end 21 of the pusher 19; the thrust ball bearing 22 includes a separator 24 with an oblique wedge-shaped cutout 31 and a separator 25 with a circular cutout 32, balls 26, 27 and an intermediate washer 28 between them with semicircular grooves 33, 34 on its upper and lower planes; a spring 29 under the top 6 button cover, one end of which is recessed into the blind cavity 18 of the guide rod 16 to return the pusher 19 to its original upper position after the user has removed the load from the top 6 button cover when rotating the rotating element 1.

Figure 2:
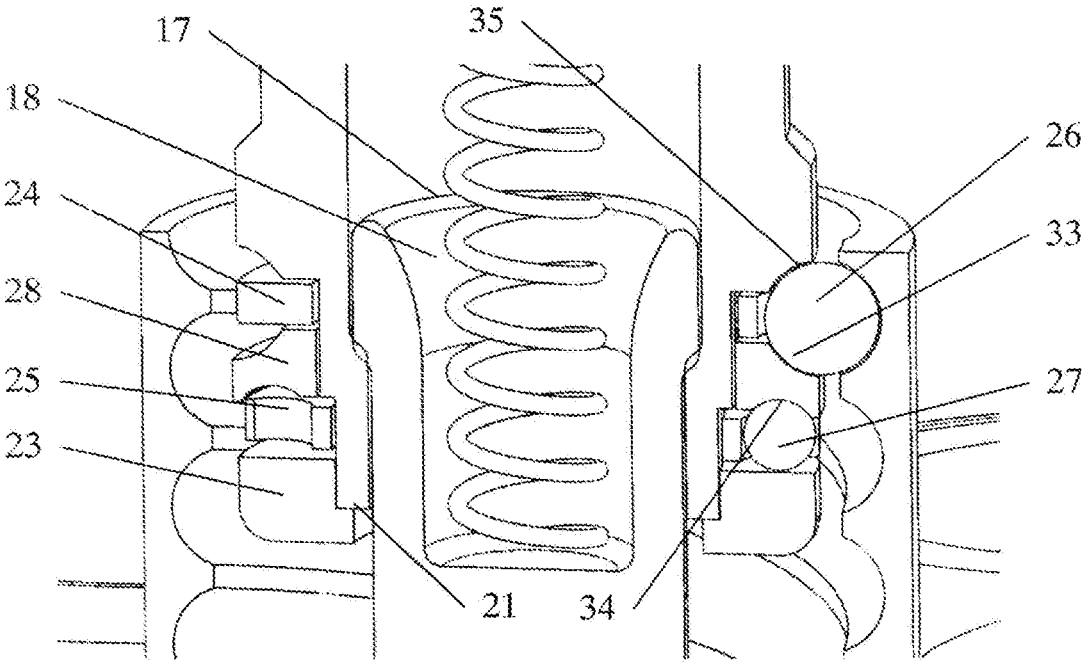
FIG. 2 is a cross-sectional view of the thrust ball bearing of the ball bearing and screw converter.
Figure 3:
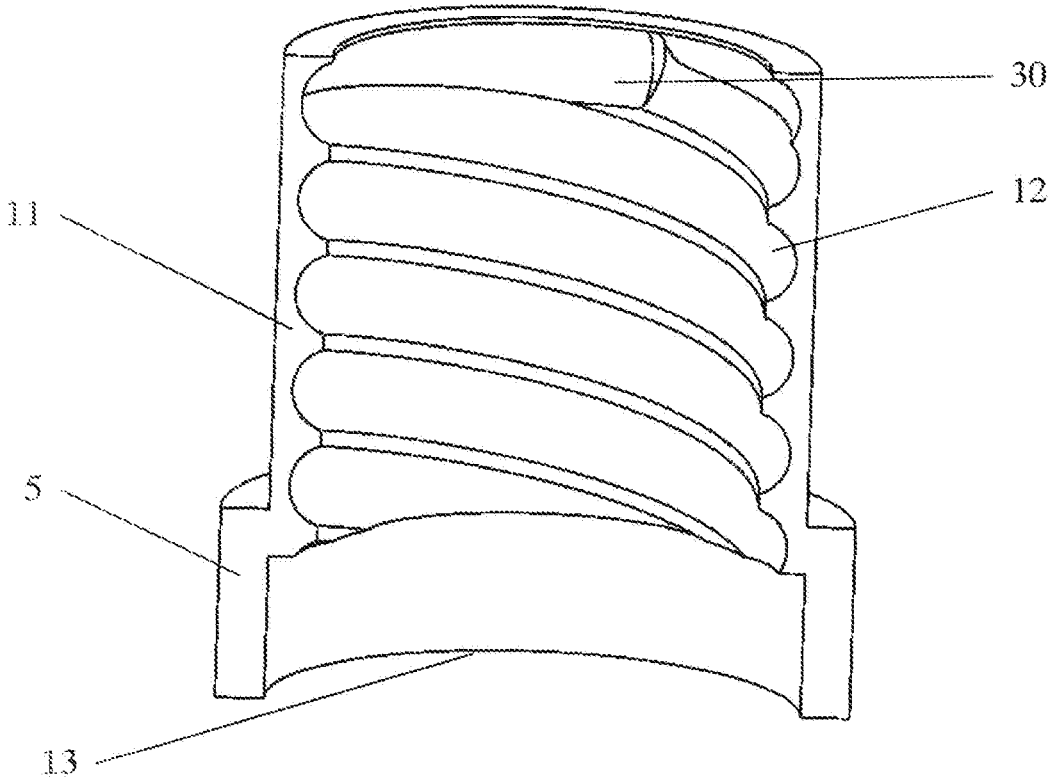
FIG. 3 is a cross-sectional view of a hollow sleeve of the body with a helical groove.
Figure 4:
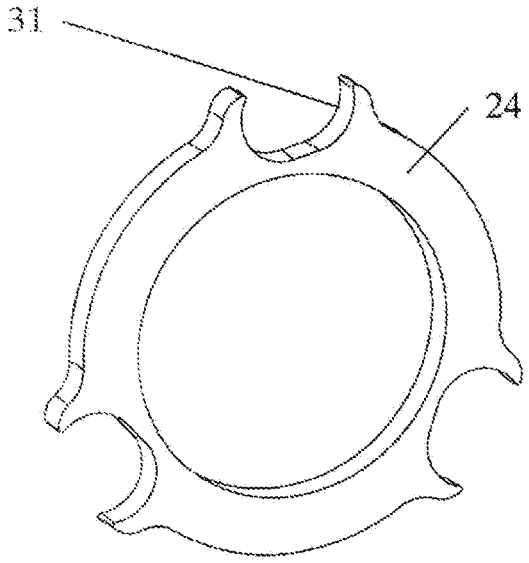
FIGS. 4 and 5 are views of the separator with wedge-shaped and circular cutouts, respectively.
Figure 5:
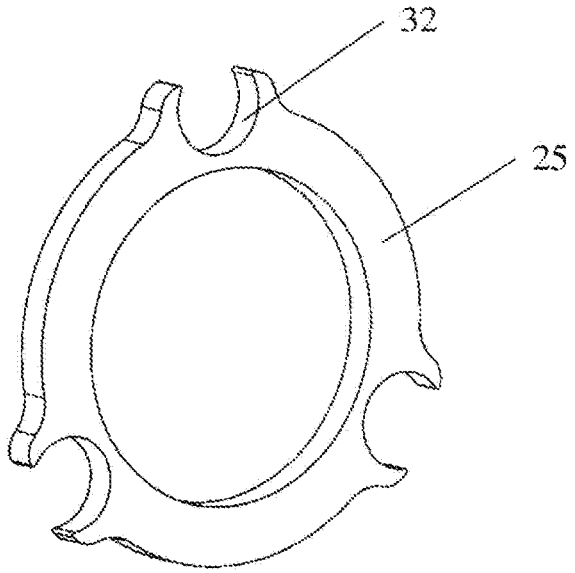
Figure 6:
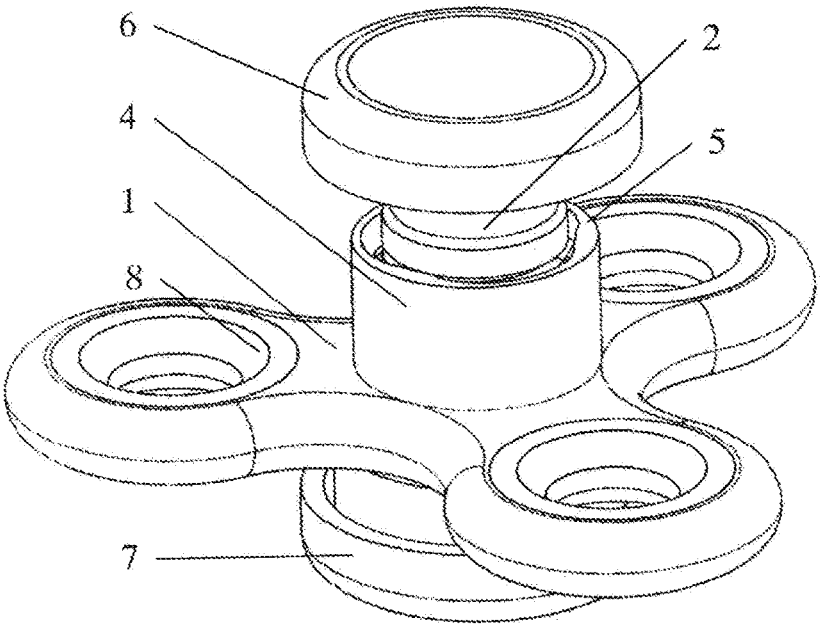
FIG. 6 is a spinner toy with a rotating element in the form of a flat body.
Figure 7:
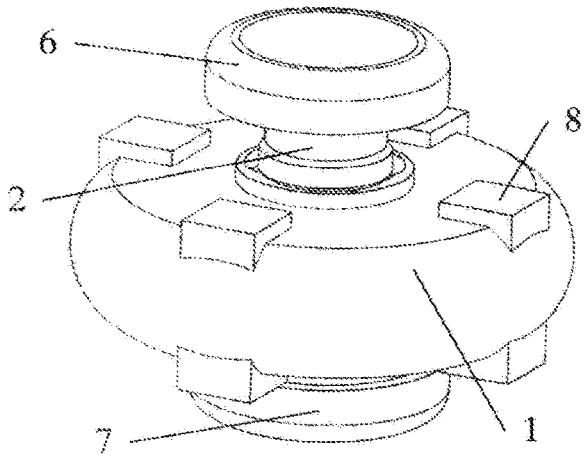
FIGS. 7 and 8 are spinner toys with barrel-shaped and cylindrical rotating elements, respectively.
Figure 8:
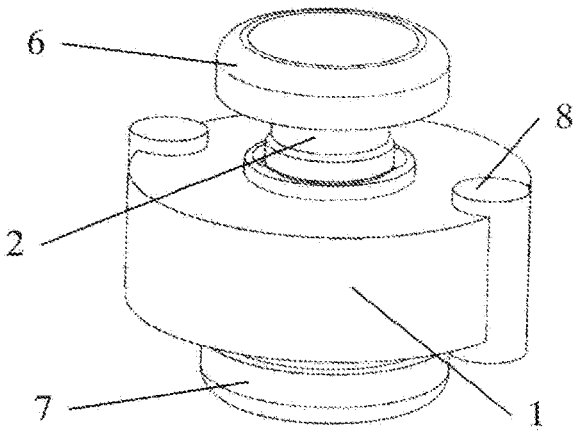

Separate parts are made and the spinner toy is assembled in accordance with the technological regulations. The rotating element 1 is made with a central hole 3, in which, coaxially with the central axis 9 of rotation, a means of rotation 2 (also known as rotation assembly) is placed, e.g. a ball bearing and screw converter 10 of reciprocating motion into unidirectional rotational motion of a rotating element 1. For this, on the outer surface 4 of the hollow sleeve 11 of the housing 5, the body of the rotating element 1 is rightly set, the body is made in a shape similar to a flat disk (FIG. 6) with the possibility of rotation about the central vertical axis 9, passing perpendicular to the flat surface of the disk. Also, the rotating element 1 can be made in the form of a volumetric body of a predetermined shape, for example, barrel-shaped (FIG. 7), or cylindrical (FIG. 8), or another predetermined shape, which is rotatable about an axis passing through its center of gravity. Massive elements 8 are arranged symmetrically to the axis of rotation 9 on the periphery of the rotating element 1. The thrust ball bearing 22 (see FIG. 1, FIG. 2) is structurally performed with a thrust washer 23 fixed on the lower end 21 of the cylinder 11 of the pusher 19 and contains two separators 24, with balls 26, 27 and an intermediate washer 28 between the separators 24, 25, which is made with the possibility of free rotation relative to the outer cylindrical surface of the pusher 19. The separator 24 contains a cutout 31 with an inclined wedge-shaped surface, which is intended for filling with balls 26, and the other separator 25 contains a cutout 32 with a circular surface shape and is intended for filling with balls 27. The dimensions of the balls 26 and 27, depending on the chosen design, are made either of the same diameter, or vice versa, balls 27 have a larger diameter than balls 26. As a special case, FIG. 2 shows the implementation of balls 26 of a larger diameter, and balls 27 of a smaller diameter and, accordingly, the intermediate washer 28 of the thrust ball bearing 22 contains semicircular grooves 33, 34 on the upper and lower planes.

Figure 10:
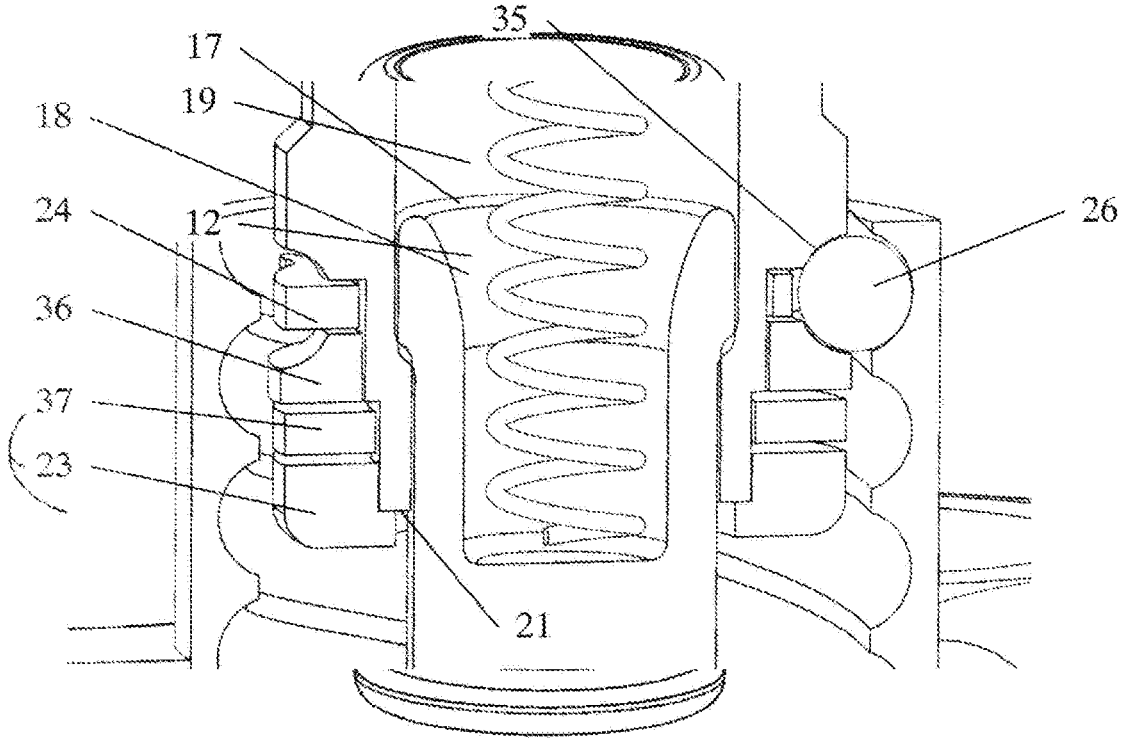
FIG. 10 is a fragment of a longitudinal section of a spinner toy with a thrust sliding bearing.

For a specialist it is obvious that in another embodiment of the invention the thrust ball bearing 22 can be replaced with a sleeve bearing (see FIG. 10), while instead of a ball and a separator, a slide washer 37 is used, and an intermediate washer 36 is made without semicircular grooves, while the rolling friction in the bearing is replaced by sliding friction.

Figure 9:
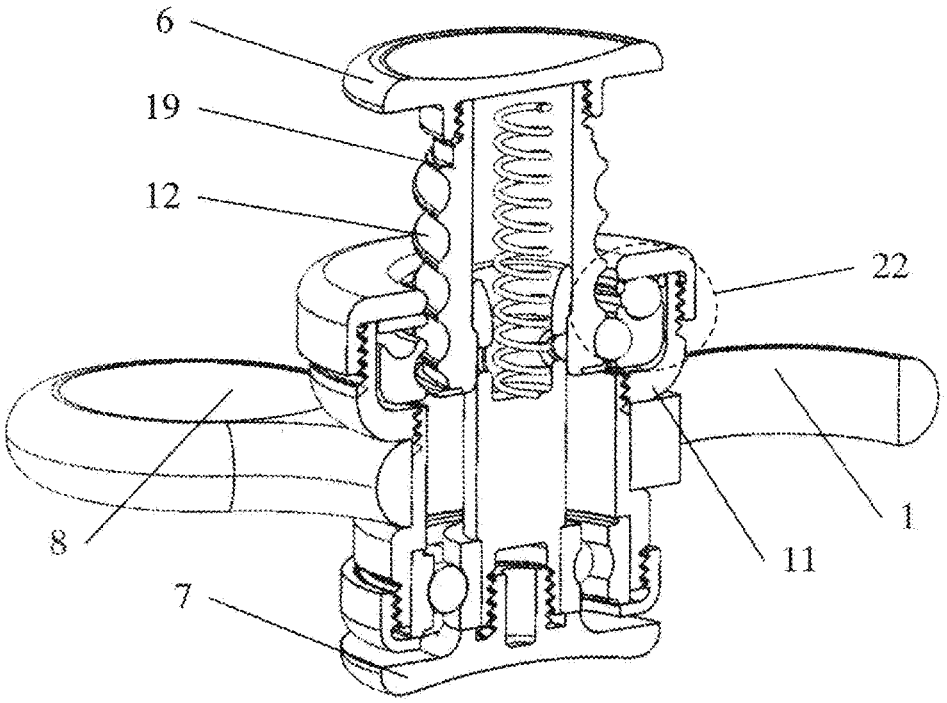
FIG. 9 is a longitudinal sectional view of a spinner toy with a ball bearing and screw converter of reciprocating motion into unidirectional rotational motion of a rotating element with helical grooves on the pusher.

Also, it is clear to the specialist that in another embodiment of the invention a variant of the design of the ball bearing and screw converter 10 of reciprocating motion into unidirectional rotational motion of the rotating element 1 is possible, when the screw grooves 12 are made on the surface of the pusher 19, and the thrust bearing 22 is placed in the sleeve 11 (see FIG. 9). Both in the first and in the second case, the ball bearing and screw converter 10 of reciprocating motion into unidirectional rotational motion of the rotating element 1 can be made with a bypass channel or without a bypass channel for a closed chain of balls 26, 27 and, accordingly, does not contain a closed chain of balls (not shown in the drawing).

A method of rotation of the spinner toy is implemented as follows. The top 6 button cover and the bottom 7 button cover of the ball bearing and screw converter 10 of the means of rotation 2 of the spinner toy are squeezed between user's fingers, and by pressing the top 6 button cover the pusher 19 is driven in reciprocating motion, which is located on the upper 20 end face of the hollow sleeve 11 and is designed to slide along the guide rod 16. After removing the load, the spring 29 each time returns the pusher 19 to the upper initial position, while the user simultaneously holds the spinner toy with the rotating element 1 in the play position (not shown in the drawing) and provides a unidirectional rotational motion to the rotating element 1 due to the mechanical transformation of the reciprocating motion of the pusher 19 along the guide rod 16 of the ball bearing and screw converter 10, which is installed coaxially with the axis of rotation 9 of the rotating element 1 in the rotational movement of the latter. Continuity of rotation without slowing down the rotating element 1 is achieved by periodically, as necessary, pressing the pusher 19 through the spring-loaded top 6 button cover of the ball bearing and screw converter 10, by returning the pusher 19 to its original upper position by the spring 29. When the pusher 19 moves to the lower position, the ball 26 moves along the axis of the sleeve 11, while the ball 26 rolls along the helical grooves 12 and drives the sleeve 11 into rotation, connected through the outer surface 4 by a tight fit with the body 5 of the ball bearing and screw converter 10, thereby imparting a torque to the rotating element 1 with massive elements 8 located symmetrically to the axis of rotation 9 at the periphery of the rotating element 1.

When holding the top 6 button cover after pressing in the lower position, the ball 26 takes a stable position in the grooves 12 of the sleeve 11 and rolls freely along the semicircular groove 33 of the intermediate washer 28 and along the semicircular groove 35 of the pusher 19. Free rolling of the ball 26 due to the low rolling friction value, has a minimal slowdown effect on the sleeve 11, which contributes to the long-term rotation of element 1, which is also supported by the moment of inertia of massive elements 8 located symmetrically to the axis of rotation 9 at the periphery of the rotating element 1. When released after pressing the top 6 button cover, the spring 9 returns pusher 19 to its original position, which, through the thrust ball bearing 22, moves the ball 26 along the helical grooves 12 of the sleeve 11, while the rotating sleeve 11 rotates the ball 26 about the axis of rotation 9 of the rotating element 1. The rotation of the ball 26 in the thrust bearing 22 causes the intermediate washer 28 to rotate and the ball 27, which rolls over the thrust washer 23, exerting minimal impact on it and does not transfer rotation to it. Thus, the support ball bearing 22 prevents the rotation of the pusher 19 and the button cover 6. After the pusher 19 returns to its original upper position, the process is repeated, as in the case of holding the top button cover 6.

REFERENCES

1. TW No. M551522, 11 Nov. 2017.
2. CN No. 107754323, 6 Mar. 2018.
3. JP No. 3212430, 7 Sep. 2017.
4. CN No. 107638699, 30 Jan. 2018.
5. U.S. Pat. No. 9,895,620, 20 Feb. 2018.
6. U.S. Pat. No. 99,114,063, 13 Mar. 2018 (prototype).
7. U.S. Pat. No. 5,135,425, 4 Aug. 1992 (prototype).

The invention claimed is:

1. A spinner toy comprising:

a rotating element, having a top surface and a central hole, a means of rotation which is mounted in the central hole of the rotating element, wherein an outer surface of a body of the means of rotation is attached to the rotating element, a top button cover, a lower button cover which is connected to the top button cover through the means of rotation, and the top button cover and the lower button cover may be held between a user's fingers, wherein the rotating element is equipped with a plurality of symmetrically placed weight elements, and the rotating element and the means of rotation are capable of rotation about a central vertical axis that runs perpendicular to the top surface of the rotating element, and the rotating element is made centrally balanced with respect to the central vertical axis, wherein the means of rotation comprises a ball bearing and screw converter that converts reciprocating motion into unidirectional rotational motion of the rotating element, wherein a housing of the ball bearing and screw converter comprises a hollow sleeve, having an inner surface and an outer surface, the inner surface of the housing comprises a helical groove of a selected profile, wherein a rotation bearing is mounted at a lower end of the hollow sleeve, with the lower button cover being attached to the lower end of the hollow sleeve, wherein an inner ring of the rotation bearing is mounted on a guide rod, with an upper end of the guide rod having a cavity and being movably connected to a pusher, which is located on an upper end of the hollow sleeve and is designed to slide along the guide rod, wherein the pusher is in a form of a hollow cylinder, the pusher having an upper end and a lower end, with a pusher bearing installed in the lower end of the pusher, wherein the top button cover is mounted at the upper end of the pusher, with a spring positioned under the top button cover, which is removable, wherein a lower end of the spring is recessed into the cavity of the guide rod, and a top end of the spring rests against the top button cover, the spring is capable of returning the pusher from a lower position to an initial upper position after the user has removed pressure from the top button cover when the rotating element rotates.

2. The spinner toy according to claim 1 wherein the rotating element is shaped as a flat disc and is capable of rotation about the central vertical axis that runs perpendicular to the top surface of the rotating element.

3. The spinner toy according to claim 1 wherein the rotating element has a planar body and is capable of rotation about the central vertical axis that runs perpendicular to the top surface of the planar body.

4. The spinner toy according to claim 1 wherein the rotating element has a volumetric body, which is configured to rotate about the vertical axis passing through a center of gravity of the volumetric body.

5. The spinner toy according to claim 4 wherein the volumetric body is a cylinder.

6. The spinner toy according to claim 4 wherein the volumetric body is barrel shaped.

7. The spinner toy according to claim 1 wherein the helical groove of the selected profile further comprises at least two screw grooves of the selected profile made on the inner surface of the housing of the hollow sleeve.

8. The spinner toy according to claim 1 wherein the top button cover is spring-loaded due to the spring positioning the pusher in the initial upper position.

9. The spinner toy according to claim 1 wherein the pusher bearing installed in the lower end of the pusher comprises a thrust bearing.

10. The spinner toy according to claim 1 wherein the pusher bearing installed in the lower end of the pusher comprises a sleeve bearing.

11. The spinner toy according to claim 1 wherein the ball bearing and screw converter further comprises a bypass channel.

12. A method of rotating a spinner toy having a rotating element, having a top surface and a central hole, a means of rotation which is mounted in the central hole of the rotating element, wherein an outer surface of a body of the means of rotation is attached to the rotating element, a top button cover, a lower button cover which is connected to the top button cover through the means of rotation, and the top button cover and the lower button cover may be held between a user's fingers, wherein the rotating element is equipped with a plurality of symmetrically placed weight elements, and the rotating element and the means of rotation are capable of rotation about a central vertical axis that runs perpendicular to the top surface of the rotating element, and the rotating element is made centrally balanced with respect to the central vertical axis, wherein the means of rotation comprises a ball bearing and screw converter that converts reciprocating motion into unidirectional rotational motion of the rotating element, wherein a housing of the ball bearing and screw converter comprises a hollow sleeve, having an inner surface and an outer surface, the inner surface of the housing comprises a helical groove of a selected profile, wherein a rotation bearing is mounted at a lower end of the hollow sleeve, with the lower button cover being attached to the lower end of the hollow sleeve, wherein an inner ring of the rotation bearing is mounted on a guide rod, with an upper end of the guide rod having a cavity and being movably connected to a pusher, which is located on an upper end of the hollow sleeve and is designed to slide along the guide rod, wherein the pusher is in a form of a hollow cylinder, the pusher having an upper end and a lower end, with a pusher bearing installed in the lower end of the pusher, wherein the top button cover is mounted at the upper end of the pusher, with a spring positioned under the top button cover, which is removable, wherein a lower end of the spring is recessed into the cavity of the guide rod, and a top end of the spring rests against the top button cover, the spring is capable of returning the pusher from a lower position to an initial upper position after the user has removed pressure from the top button cover when the rotating element rotates, the method comprising:

initiating a first rotation to the rotating element, initiating a second rotation of the rotating element without interrupting the first rotation of the rotating element.

13. The method of rotating a spinner toy according to claim 12, wherein the second rotation is accomplished by transformation of a reciprocating motion of the means of rotation into unidirectional rotational motion without slowing down the first rotation of the rotating element.

14. The method of rotating a spinner toy according to claim 12, wherein the first rotation and the second rotation combine into a continuous rotation of the rotation element.

15. The method of rotating of a spinner toy according to claim 12, wherein the initiating of the second rotation further comprises pressing the top button cover of the ball bearing and screw converter, while simultaneously holding the spinner toy between the user's fingers.

16. The method of rotating of a spinner toy according to claim 15, wherein the top button cover is spring-loaded due to the spring positioning the pusher in the initial upper position.

* * * * *